US006251984B1

(12) United States Patent
Shimada et al.

(10) Patent No.: US 6,251,984 B1
(45) Date of Patent: Jun. 26, 2001

(54) AQUEOUS DISPERSION TYPE ANTISOILING COMPOSITION

(75) Inventors: Toyomichi Shimada; Takashige Maekawa, both of Kanagawa (JP)

(73) Assignee: Asahi Glass Company Ltd., Tokyo (JP)

( * ) Notice: Subject to any disclaimer, the term of this patent is extended or adjusted under 35 U.S.C. 154(b) by 0 days.

(21) Appl. No.: 09/433,725

(22) Filed: Nov. 4, 1999

(30) Foreign Application Priority Data

Nov. 13, 1998 (JP) ..... 10-323884

(51) Int. Cl.[7] ..... C08L 75/00
(52) U.S. Cl. ..... 524/507; 524/200
(58) Field of Search ..... 524/507

(56) References Cited

U.S. PATENT DOCUMENTS 5,350,795 * 9/1994 Smith et al. ..... 524/507
5,548,022 * 8/1996 Ito ..... 524/829

FOREIGN PATENT DOCUMENTS 0 692 566 1/1996 (EP) .
10-204777 8/1998 (JP) .
WO 96/30584 10/1996 (WO) .

* cited by examiner

*Primary Examiner*—Paul R. Michl
(74) *Attorney, Agent, or Firm*—Oblon, Spivak, McClelland, Maier & Neustadt, P.C.

(57) ABSTRACT

An aqueous dispersion type antisoiling composition comprising an aqueous medium, and fine particles of the following reaction product (A) and fine particles of the following addition polymer (B), dispersed in the aqueous medium, or an aqueous medium, and fine particles comprising the reaction product (A) and the addition polymer (B), dispersed in the aqueous medium:

Reaction product (A): a reaction product of compounds (a1), (a2) and (a3);

Compound (a1): a compound having a polyfluoroalkyl group and a group having an active hydrogen atom reactive with an isocyanate group;

Compound (a2): a compound having no polyfluoroalkyl group and a group having an active hydrogen atom reactive with an isocyanate group;

Compound (a3): a polyisocyanate compound;

Addition polymer (B): a copolymer comprising polymer units of a polyfluoroalkyl group-containing (meth) acrylate and polymer units of methyl methacrylate.

16 Claims, No Drawings

AQUEOUS DISPERSION TYPE ANTISOILING COMPOSITION

The present invention relates to an aqueous dispersion type antisoiling composition suitable for water and oil repellency treatment or antisoiling treatment of carpets or cloths for upholstery.

For the purpose of imparting an antisoiling property to fibers, it is widely practiced to treat the fibers with a fluorine-type water and oil repellant. However, carpets and cloths for upholstery are required to have not only water and oil repellency, but also an antisoiling property against solid soil such as mud or dust, i.e. a dry soil resistance and a soil-removal property whereby soil can readily be removed. When a conventional fluorine-type water and oil repellant is used as an antisoiling composition in this field, water and oil repellency may be obtained to some extent, but it is difficult to obtain adequate dry soil resistance or its durability, since the hardness of a coating formed on the fiber surface is inadequate.

Therefore, the following treating agents (1) to (6) i.e. compositions comprising a fluorine-containing compound and another compound for improving the coating hardness, or treating agents made of e.g. a fluorine-containing copolymer having a high coating hardness, have been proposed.

(1) A mixture comprising a polymer main agent for imparting water and oil repellency and a polymer for imparting dry soil resistance, (2) A mixture comprising a polymer containing no fluorine atom and a polyfluoroalkyl group-containing urethane compound (JP-A-55-128075), (3) A mixture comprising a polymer having a polyfluoroalkyl group and a water-insoluble ester having both a fluorine atom and a chlorine atom (JP-A-58-134143).

(4) A copolymer of a polymerizable perfluoroalkyl group-containing urethane compound with a monomer for imparting dry soil resistance, (5) A yarn-treating agent comprising a perfluoroalkyl group-containing urethane compound or a carbodiimide compound, (6) A mixture comprising a fluorine-containing compound having a certain specific urethane bond and a polymethyl methacrylate (JP-B-4-28829).

However, the above treating agents have various problems. For example, the treating agents (1), (2) and (3) provide no adequate performance unless they are used in high concentrations. The copolymer (4) requires many steps for its synthesis, and the operation of such steps is cumbersome. The treating agent (5) is incapable of imparting an adequate antisoiling property. The mixture (6) is a treating agent for flame retardancy, but it is inadequate in the basic performance of e.g. dry soil resistance or soil-removal property, and its texture at the time of treatment is not satisfactory.

It is an object of the present invention to provide an antisoiling composition which satisfies both water and oil repellency and dry soil resistance (durability of an antisoiling property and a soil-removal property). Namely, it is an object of the present invention to provide an antisoiling composition whereby the hardness of a coating formed is high, durability of an antisoiling property against solid soil such as mud or stone dust, is high, and deposited soil can readily be removed.

The present invention provides an aqueous dispersion type antisoiling composition comprising an aqueous medium, and fine particles of the following reaction product (A) and fine particles of the following addition polymer (B), dispersed in the aqueous medium, or an aqueous medium, and fine particles comprising the reaction product (A) and the addition polymer (B), dispersed in the aqueous medium:

Reaction product (A): a reaction product of compounds (a1), (a2) and (a3);

Compound (a1): a compound having a polyfluoroalkyl group and a group having an active hydrogen atom reactive with an isocyanate group;

Compound (a2): a compound having no polyfluoroalkyl group and a group having an active hydrogen atom reactive with an isocyanate group;

Compound (a3): a polyisocyanate compound;

Addition polymer (B): a copolymer comprising polymer units of a polyfluoroalkyl group-containing (meth)acrylate and polymer units of methyl methacrylate.

Now, the present invention will be described in detail with reference to the preferred embodiments.

In the following description, "a polyfluoroalkyl group" will be represented by "a $R^f$ group", "a perfluoroalkyl group" will be represented by "a $R^F$ group", and "a group having an active hydrogen atom reactive with an isocyanate group" will be represented by "an active hydrogen-containing group". Further, "acrylate and/or methacrylate" will be represented by "(meth)acrylate". A similar representation applies to other expressions such as "(meth)acrylic acid".

The reaction product (A) in the present invention is a reaction product of compounds (a1), (a2) and (a3) and is usually a reaction product obtained by a condensation reaction of such compounds.

The compound (a1) is a compound having a $R^f$ group and an active hydrogen-containing group. As the compound (a1), preferred is a compound having one $R^f$ group and one active hydrogen-containing group.

The $R^f$ group is a group having at least two hydrogen atoms of an alkyl group substituted by fluorine atoms. The carbon number of the $R^f$ group is preferably from 4 to 20, particularly preferably from 6 to 16. The $R^f$ group may be of a linear structure or a branched structure. Further, the $R^f$ group may have an etheric oxygen atom inserted between a carbon-carbon bond or may contain a carbon-carbon double bond.

The number of fluorine atoms in the $R^f$ group is preferably at least 60%, particularly preferably at least 80%, when represented by [the number of fluorine atoms in the $R^f$ group/the number of hydrogen groups contained in the corresponding alkyl group having the same carbon number as the $R^f$ group]×100 (%). Further, as the $R^f$ group, preferred is a group having all hydrogen atoms in the alkyl group substituted by fluorine atoms i.e. a $R^F$ group represented by the formula $C_mF_{2m+1}$— (wherein m is an integer of from 4 to 20), and particularly preferred is a linear $R^F$ group wherein the average of m is from 6 to 16.

The $R^f$ group may be a group having hydrogen atoms or chlorine atoms at the terminal portion, or may be a group having an oxypolyfluoroalkylene moiety. For example, the terminal may be a difluoromethyl group or a chlorodifluoromethyl group.

Specific examples of the $R^f$ group will be given below, but the $R^f$ group is not limited to such specific examples.

$C_4F_9$— (any one of structurally isomeric groups, such as $F(CH_2)_4$—, $(CF_3)_2CFCF_2$—, $(CF_3)_3C$— or $CF_3CF_2CF(CF_3)$—), $C_5F_{11}$— (such as $F(CF_2)_5$—), $C_6F_{13}$— (such as $F(CF_2)_6$—), $C_7F_{15}$— (such as $F(CF_2)_7$—, $C_8F_{17}$— (such as $F(CF_2)_8$—), $C_9F_{19}$— (such as $F(CF_2)_9$—), $C_{10}F_{21}$— (such as $F(CF_2)_{10}$—), and $H(CF_2)_p$— (wherein p is an integer of from 2 to 16).

As the compound (a1), preferred is a compound represented by the following formula 1. Namely, preferred is a compound wherein the $R^f$ group and an active hydrogen-containing group are indirectly bonded via a connecting group. Particularly preferred is a compound wherein one $R^f$ group is bonded to an active hydrogen-containing group via a bivalent organic group.

$R^f$—Q—X formula 1

In the formula 1, $R^f$ represents a $R^f$ group and is preferably a $R^F$ group. Q represents a bivalent connecting group, and X represents an active hydrogen-containing group, or a hydrogen atom when the X side terminal of Q is an oxygen atom, a nitrogen atom or a sulfur atom. It is preferred that at least one hydrogen atom is bonded to the carbon atom of $R^f$ bonded to Q.

Preferred as Q is, for example, —$(CH_2)_n$—, —CO—, —CONR—, —$SO_2NR$—, —$SO_2NR(CH_2)_n$—, —$SO_2$—, —$C_6H_4$— (1,4—phenylene group), —$C_6H_3Cl$—(chloro-1, 4—phenylene group) or —$OC_2H_4$— (wherein R is a hydrogen atom or a $C_{1-6}$ alkyl group, and n is an integer of from 1 to 20). In Q, —CONR— may be —NRCO—, and likewise, the direction is not questioned also with respect to other groups. Among these groups, preferred is —$(CH_2)_n$— or —$SO_2NR(CH_2)_n$— (wherein R is a $C_{1-6}$ alkyl group) wherein n is from 1 to 5. Particularly preferred is —$(CH_2)_2$— or —$SO_2NR(CH_2)_2$— (wherein R is a methyl group or an ethyl group).

X is preferably, for example, a hydrogen atom, an amino group, a carboxyl group or a mercapto group, and particularly preferred is a hydroxyl group.

As the compound (a1), a (perfluoroalkyl)alkyl alcohol is preferred. Specific examples of the compound (a1) will be given below, but the compound (a1) is not limited to such specific examples.

$R^fCH_2CH_2OH$, $R^fCH_2CH_2CH_2OH$, $R^fSO_2N(CH_3)CH_2CH_2OH$, $R^fCON(CH_3)CH_2CH_2OH$, $R^fCH_2CH_2NH_2$, $R^fSO_2N(CH_3)CH_2CH_2NH_2$, $R^fCH_2CH_2COOH$, $R^fSO_2N(CH_3)CH_2CH_2COOH$.

The compound (a2) is a compound having an active hydrogen-containing group and no $R^f$ group. A hydroxyl group is preferred as the active hydrogen-containing group in the compound (a2). The compound (a2) serves to increase the hardness of the coating formed from the reaction product (A).

As the compound (a2) having a hydroxyl group, preferred is a compound represented by the formula $R^1$ OH (wherein $R^1$ is a $C_{1-22}$ alkyl group, an epoxy group, a glycidyl group, an aziridinyl group or a $C_{1-22}$ halogenated alkyl group).

Preferred as the compound (a2) is, for example, butanol, octyl alcohol, octadecyl alcohol, ethylene glycol monoalkyl ether, polyethylene glycol monomethyl ether, polyethylene glycol monoethyl ether, polypropylene glycol monoalkyl ether or glycidol. Particularly preferred is an epoxy group-containing alcohol (such as glycidol) or a linear alkyl alcohol having at least 16 carbon atoms (such as octadecyl alcohol). Two or more such compounds (a2) may be used in combination.

The compound (a3) is a polyisocyanate compound. The number of isocyanate groups in the compound (a3) is preferably from 2 to 6 per molecule, and from the viewpoint of the performance, it is particularly preferably 3. An aromatic polyisocyanate compound wherein isocyanate groups are directly bonded to an aromatic nucleus, is not suitable, since the color is likely to change after the anti-soiling treatment. Accordingly, preferred as the compound (a3) is an aliphatic polyisocyanate, an alicyclic polyisocyanate or an aromatic polyisocyanate having no isocyanate group directly bonded to the aromatic nucleus (such as xylene diisocyanate (XDI)).

Preferred as the compound (a3) is, for example, hexamethylene diisocyanate, isophorone diisocyanate, trimethylhexamethylene diisocyanate, 4,4'diphenylmethane diisocyanate (MDI), hydrogenated MDI, XDI, hydrogenated XDI, as well as their isocyanurate modified products, trimethylolpropane modified products or biuret modified products.

Among the above, particularly preferred is hexamethylene diisocyanate, isophorone diisocyanate as well as their isocyanurate modified products, trimethylolpropane modified products or biuret modified products. Especially preferred is tris-biuret of an aliphatic diisocyanate, such as tris-biuret of hexamethylene diisocyanate.

The amount of the compound (a2) is preferably from 0.1 to 30 wt % relative to the compound (a1), and it is preferred to employ an amount whereby all isocyanate groups of the compound (a3) can be reacted by the reaction of the compound (a1) with the compound (a3). Usually, the reaction product (A) contains no unreacted isocyanate group. The amount of the compound (a3) is preferably from 30 to 90 wt %, particularly preferably from 50 to 80 wt %, relative to the compound (a1).

The reaction product (A) is preferably prepared by heating in the presence of a solvent in accordance with one of the following methods (a), (b) or (c).

(a) A method wherein an excess equivalent amount of the compound (a3) is reacted to the compound (a1), and the compound (a2) is reacted to unreacted isocyanate groups.

(b) A method wherein an excess equivalent amount of the compound (a3) is reacted to the compound (a2), and then the compound (a1) is reacted to unreacted isocyanate groups.

(c) A method wherein the compounds (a1) and (a2) are reacted with the compound (a3).

In either method, two or more compounds (a1) may be reacted, and when two or more compounds are reacted, they are preferably compounds different in the number of carbon atoms in the respective $R^f$ groups. Also with respect to the compound (a2), two or more different compounds may be reacted.

The reaction temperature is preferably from 60 to 110° C. When a compound having a hydroxyl group or an amino group as the active hydrogen-containing group, is employed, the reaction temperature is preferably from 60 to 90° C., and when a compound having a carboxyl group as the active hydrogen-containing group, is employed, the reaction temperature is preferably from 90 to 110° C. The time for the reaction is preferably from 4 to 8 hours.

The solvent to be used for the reaction is preferably a non-aqueous organic solvent having no active hydrogen atom, such as methyl isobutyl ketone, diethyl succinate, ethyl acetate or butyl acetate. Otherwise, it may be a water-soluble organic solvent having no active hydrogen atom, such as methyl ethyl ketone.

The reaction may be carried out in the presence of a catalyst. As the catalyst, a catalyst containing tin or copper is preferred, and readily available dibutyltin dilaurate is particularly preferred. The amount of the catalyst is preferably from 0.01 to 0.1 part by weight per 1 part by weight of isocyanate groups.

The molecular weight of the reaction product (A) is preferably from 500 to 5,000, particularly preferably from 1,000 to 3,000.

An aqueous medium wherein fine particles of the reaction product (A) are dispersed ("an aqueous medium wherein fine particles are dispersed" will be referred to as "an aqueous dispersion") is obtained by preparing a solvent solution comprising the reaction product (A), followed by emulsification. Such emulsification is preferably carried out in the presence of water, an emulsifier and an organic solvent. The amount of water in the aqueous dispersion is preferably from 50 to 800 wt %, particularly preferably from 100 to 400 wt %, relative to the reaction product (A).

The emulsifier is not particularly limited, and at least one emulsifier of nonionic, anionic, cationic or amphoteric type, may be employed. However, in a case where the treatment is carried out in the same treating bath as for an anionic substance such as a stain blocker, a cationic emulsifier is not desirable, since it impairs the stability of the treating bath.

Specific examples of the emulsifier will be given below, but the emulsifier is not limited to such specific examples. In the following examples of the emulsifier, the alkyl group moiety is a $C_{4-26}$ linear or branched saturated aliphatic group, such as an octyl group, a dodecyl group, a tetradecyl group, a hexadecyl group, an octadecyl group, a behenyl group or a secondary alkyl group. Further, the alkyl group moiety may be replaced by an alkenyl group moiety such as an oleyl group.

The nonionic emulsifier may, for example, be a polyoxyethylenealkylphenyl ether, a polyoxyethylenealkyl ether, a poly(oxyalkylene-oxyethylene)alkyl ether, a higher fatty acid ester, a polyoxyethylenealkylamine, a polyoxyethylenealkylamide, a poly(oxyethylene oxypropylene)alkylamine or an alkylamineoxide.

The polyoxyethylenealkylphenyl ether may, for example, be polyoxyethylenenonylphenyl ether or polyoxyethyleneoctylphenyl ether.

The poly(oxyalkylene-oxyethylene)alkyl ether may, for example, be polyoxypropylenepolyoxyethylenealkyl ether or polyoxybutylenepolyoxyethylenealkyl ether.

The anionic emulsifier may, for example, be a higher fatty acid salt, an α-olefin sulfonate, an alkylbenzene sulfonic acid or its salt, an alkyl sulfate, an alkylether sulfate, an alkylphenylether sulfate, a methyltaurine salt or an alkyl sulfosuccinate.

The cationic emulsifier may, for example, be an amine salt, a quaternary ammonium salt or an oxyethylene addition type ammonium hydrochloride. Specifically, a trimethylmono-chain alkyl ammonium hydrochloride, a dimethyldi-long chain alkyl ammonium hydrochloride, a mono-long chain alkylamine acetate or a mono-long chain alkylmonomethyldi-poly(oxyethylene)ammonium hydrochloride.

The amphoteric emulsifier may, for example, be alanines, imidazolinium betaines, amide betaines or betaine acetate. Specifically, dodecylcarboxymethylhydroxyethylimidazolinium betaine, dodecyldimethylaminoacetate betaine or a fatty acid amidepropyldimethylaminoacetate betaine, may, for example, be mentioned.

The amount of the emulsifier is preferably from 1 to 40 wt %, particularly preferably from 5 to 20 wt %, relative to the reaction product (A). Two or more emulsifiers may be employed in combination.

The organic solvent may be the same as the solvent used for the preparation of the reaction product (A) or may be a different solvent. Otherwise, two or more solvents may be used in combination. The amount of the solvent is not particularly limited, but it is preferably from 10 to 150 wt %, particularly preferably from 20 to 100 wt %, relative to the reaction product (A).

As the organic solvent, preferred is a water-soluble organic solvent as it improves stability of the resulting aqueous dispersion. As the water-soluble organic solvent, a glycol is preferred. Particularly preferred is propylene glycol, propylene glycol monomethyl ether, propylene glycol monoethyl ether, dipropylene glycol, dipropylene glycol monomethyl ether or dipropylene glycol monoethyl ether. The amount of the water-soluble organic solvent is preferably from 10 to 50 wt %, relative to the reaction product (A).

A more stable aqueous dispersion can be obtained by mechanically forcibly emulsifying a mixture comprising water, an emulsifier and an organic solvent by a homogenizer. The forcible emulsification temperature is preferably at least the softening temperature of the reaction product (A), particularly preferably from 60 to 100° C. After obtaining the aqueous dispersion, a part or all of the organic solvent may be removed under reduced pressure.

The average particle size of fine particles of the reaction product (A) in the aqueous dispersion of the reaction product (A) is preferably from 0.01 to 0.3 μm.

The aqueous dispersion type antisoiling composition of the present invention contains an addition polymer (B).

The addition polymer (B) is a copolymer comprising polymer units of a $R^f$ group-containing (meth)acrylate and polymer units of methyl methacrylate. The fluorine content in the addition polymer (B) is preferably from 3 to 30 wt %, more preferably from 5 to 20 wt %, particularly preferably from 5 to 15 wt %. When the fluorine content of the addition polymer (B) is within the above range, its compatibility with the reaction product (A) will be good whereby film-formation on the fibers will be facilitated, and the formed coating itself will be flexible, whereby dry soil resistance will be improved.

The $R^f$ group-containing (meth)acrylate for the addition polymer (B) can be prepared from a $R^f$ group-containing alcohol. As the $R^f$ group for the $R^f$ group-containing alcohol, a linear group is preferred, and particularly preferred is a $C_{4-16}$ $R^F$ group. The $R^f$ group-containing alcohol is preferably selected from the above-mentioned $R^f$ group-containing alcohols disclosed with respect to the compound (a1). The $R^f$ group-containing alcohol may be the same or different from the compound (a1).

Preferred as the $R^f$ group-containing (meth)acrylate is $F(CF_2)_qCH_2CH_2OCOCH{=}CH_2$ (a mixture of substances wherein q is 6, 8, 10, 12, 14 and 16, and the average of q is 9, which will be hereinafter referred to as FA).

The amount of polymer units of the $R^f$ group-containing (meth)acrylate in the addition polymer (B) is preferably from 2 to 50 wt %, more preferably from 5 to 25 wt %, particularly preferably from 5 to 20 wt %.

The amount of polymer units of methyl methacrylate in the addition polymer (B) is preferably from 50 to 98 wt %, particularly preferably from 70 to 90 wt %.

The addition polymer (B) may contain polymer units of other polymerizable monomers in addition to the above essential components, for the purpose of adjusting the durability or texture. As such other polymerizable monomers, preferred are carboxylic acids containing unsaturated groups, such as (meth)acrylic acid, (meth)acrylates, vinyl compounds, vinyl halide compounds, olefins and styrenes, and particularly preferred are (meth)acrylates of $C_{3-5}$ alcohols and styrenes.

The following may be mentioned as specific examples of such other polymerizable monomers.

Trimethoxysilylpropyl (meth)acrylate, aziridinyl (meth) acrylate, glycidyl (meth)acrylate, ethylene di(meth)acrylate, hydroxyalkyl (meth)acrylate, 3—chloro-2—hydroxypropyl (meth)acrylate, benzyl (meth)acrylate, cyclohexyl (meth) acrylate, a mono- or di- (meth)acrylate of a polyoxypropylene diol, a (meth)acrylate having an organopolysiloxane residue, N-methylol (meth)acrylamide, diacetone (meth) acrylamide, methylol-modified diacetone (meth)acrylamide, (meth)acrylamide, butyl (meth)acrylate, etc.

The aqueous dispersion of the addition polymer (B) is preferably prepared by subjecting the $R^f$ group-containing (meth)acrylate and methyl methacrylate to emulsion copolymerization, if necessary, together with other polymerizable monomers. Such emulsion copolymerization is preferably carried out in the presence of water, an emulsifier and a polymerization initiator. The amount of water in the aqueous dispersion is preferably from 50 to 900 wt %, particularly preferably from 100 to 400 wt %, relative to the addition polymer (B).

As the emulsifier, the above-mentioned emulsifier can be used, and it may be the same or different from the emulsifier used for the preparation of the aqueous dispersion of the compound (A). The polymerization initiator is not particularly limited, and a known polymerization initiator may be employed. For example, an organic peroxide, an azo compound, a persulfate or an ionizable radiation such as γ-rays may, preferably, be mentioned.

The average particle size of fine particles of the addition polymer (B) in the aqueous dispersion of the addition polymer (B) is preferably from 0.05 to 0.5 μm The aqueous dispersion type antisoiling composition of the present invention can be prepared by mixing the above aqueous dispersion of the reaction product (A) and the above aqueous dispersion of the addition polymer (B). Otherwise, the composition of the present invention can be prepared also by a method wherein the above addition polymer (B) is formed in the aqueous dispersion of the reaction product (A) by e.g. emulsion polymerization, or by a method wherein the above reaction product (A) is emulsified into the aqueous dispersion of the addition polymer (B).

For example, when the addition polymer (B) is formed by emulsion polymerization using the aqueous dispersion of the reaction product (A) as a medium, fine particles containing both the reaction product (A) and the addition polymer (B) are believed to be formed. Of course, fine particles composed solely of the addition polymer (B) may also be formed, and it is also conceivable that fine particles of the reaction product (A) will remain without having the addition polymer (B) included. The composition of the present invention may be a composition comprising fine particles composed solely of the reaction product (A) and fine particles composed solely of the addition polymer (B), or a composition comprising fine particles comprising both the reaction product (A) and the addition polymer (B). The average particle size of fine particles comprising both the reaction product (A) and the addition polymer (B) is preferably from 0.03 to 0.5 μm.

The aqueous dispersion type antisoiling composition of the present invention is preferably an aqueous dispersion type antisoiling composition wherein fine particles of the reaction product (A) and fine particles of the addition polymer (B) are dispersed in an aqueous medium as the respectively independent two types of fine particles.

After its production by e.g. mixing, the composition of the present invention may be, diluted with water or an aqueous medium to adjust the composition. Usually, dilution is carried out, and by diluting it with water, the amount of the organic solvent in the water type antisoiling composition to be finally used, can be reduced.

The proportion of the component of the reaction product (A) and the proportion of the addition polymer (B) contained in the aqueous dispersion type antisoiling composition are such that the weight ratio of the reaction product (A)/the addition polymer (B) is preferably from 20/80 to 80/20, particularly preferably from 25/75 to 75/25.

The aqueous dispersion type antisoiling composition of the present invention may contain additional components in addition to the above-described components. As such additional components, other antisoiling agents, a water repellant, an oil repellant, a crosslinking agent, an insecticide, a flame-retardant, an antistatic agent, a dye-stabilizer or a crease-preventing agent may, for example, be mentioned.

The concentration of the aqueous dispersion type antisoiling composition of the present invention may be adjusted depending upon the substrate to be treated or the type of formulation. It is usually preferred to adjust the fluorine amount at a level of from 100 to 1,000 ppm relative to the substrate to be treated.

The water dispersion type antisoiling composition of the present invention can be applied to a substrate to be treated by an optional method depending upon the type of the substrate to be treated or the type of formulation. For example, a method may be employed wherein the composition is applied to the surface of the substrate by a coating method such as a dip coating method, followed by drying. If necessary, curing may be carried out. Otherwise, the treatment may be carried out by spraying, or the treatment may be carried out at the stage of spinning.

After the treatment, the substrate treated with the aqueous dispersion type antisoiling composition of the present invention is preferably subjected to heat treatment. The heat treatment is preferably carried out at a temperature of from 80 to 150° C. for from 5 to 30 minutes.

The substrate to be treated by the aqueous dispersion type antisoiling composition of the present invention is not particularly limited. It may, for example, be fibers, fiber fabrics, fiber knitted products, glass, paper, wood, leather, wool, asbestos, bricks, cement, ceramics, metals, metal oxides, porcelain products or plastics. As the fibers, woven fibers or fiber fabrics, animal or plant natural fibers such as cotton, hemp, wool or silk, synthetic fibers such as polyamide, polyester, polyvinyl alcohol, polyacrylonitrile, polyvinyl chloride or polypropylene, semisynthetic fibers such as rayon or acetate, inorganic fibers such as glass fibers or carbon fibers, or fabrics or knitted products of mixed fibers thereof, may preferably be mentioned.

The substrate to be treated with the aqueous dispersion type antisoiling composition of the present invention may preferably be in the form of carpets, curtains or upholstered chairs.

Now, the present invention will be described in further detail with reference to Preparation Examples (Examples 1 to 16), Working Examples (Examples 17 to 28 and 32 to 34) and Comparative Examples (Examples 29 to 31 and 35 to 37). However, it should be understood that the present invention is by no means restricted by such specific Examples.

The water repellency, the oil repellency and the dry soil resistance were evaluated by the following methods.

Water Repellency

An aqueous solution of isopropyl alcohol (IPA) as shown in Table 1, was put on a test cloth (diameter: about 4 mm), and the water repellency was evaluated in accordance with AATCC-TM118-1966 and represented by the maximum water repellency grade where no wetting was observed for 3 minutes. The larger the numerical value, the better the water repellency.

TABLE 1

| Water repellency grade | Test liquid (wt %) |
|---|---|
| 12 | IPA |
| 11 | IPA90/water 10 |
| 10 | IPA80/water 20 |
| 9 | IPA70/water 30 |
| 8 | IPA60/water 40 |
| 7 | IPA50/water 50 |
| 6 | IPA40/water 60 |
| 5 | IPA30/water 70 |
| 4 | IPA20/water 80 |
| 3 | IPA10/water 90 |
| 2 | IPA5/water 95 |
| 1 | IPA2/water 98 |
| 0 | Less than 1 |

Oil Repellency

In accordance with AATCC-TM118-1966, a few drops (diameter: about 4 mm) of a test liquid as shown in Table 2, were put at two portions of a test cloth, and the oil repellency was evaluated by the penetration of the terst liquid after 30 seconds and represented by the oil repellency grade as identified in Table 2.

TABLE 2

| Oil repellency grade | Test liquid | Surface tension dyn/cm (25° C.) |
|---|---|---|
| 8 | n-heptane | 20.0 |
| 7 | n-octane | 21.8 |
| 6 | n-decane | 23.5 |
| 5 | n-dodecane | 25.0 |
| 4 | n-tetradecane | 26.7 |
| 3 | n-hexadecane | 27.3 |
| 2 | 35 parts of n-hexadecane/65 parts of nujol | 29.6 |
| 1 | nujol | 31.2 |
| 0 | Less than 1 | — |

Dry Soil Resistance

Using a nujol-containing soil (manufactured by 3M Co.) and a carpet, a test simulating human walking was carried out by a rotary type stepping test machine. Once a day, the carpet was cleaned by a vacuum cleaner, and after a period corresponding to three months of actual walking, the chromaticity of the carpet was measured by a color-difference meter. The dry soil resistance was evaluated by the color difference from the non-soiled cloth. The smaller the numerical value of the color difference, the better the dry soil resistance.

EXAMPLE 1

Preparation of Reaction Product (A)

Into a 2l glass reactor equipped with a thermometer, a dropping funnel, a stirrer and a Dimroth condenser, 100 g of methyl isobutyl ketone (hereinafter referred to as MIBK), and 220 g of hexamethylene diisocyanate trisbiuret (NCO= 23%) were charged, and nitrogen substitution was carried out. Then, after raising the temperature to 70° C., 0.08 g of dibutyltin dilaurate was added as a catalyst, and sequentially from the dripping funnel, 41 g of octadecyl alcohol was dropwise added for 2 hours, 17 g of glycidol for 1 hour, and 422 g of $C_tF_{2t+1}CH_2CH_2OH$ (a mixture of substances wherein t is 6, 8, 10, 12, 14 and 16, and the average of t is 9, hereinafter referred to as FE) for 3 hours. Stirring was continued for further 30 minutes, to obtain a MIBK solution of the reaction product (A). The solution was analyzed by an infrared spectrophotometry, whereby disappearance of the characteristic absorption by an isocyanate group, was confirmed.

EXAMPLE 2

Preparation of an Aqueous Dispersion of Reaction Product (A)

Into a 3l container, 400 g of the MIBK solution of the reaction product (A) obtained in Example 1 (solid content: 88 wt %), 80 g of MIBK, 950 g of deionized water, 32 g of a nonionic emulsifier ("Emulgen 950", tradename, manufactured by Kao Corporation), 8.0 g of an anionic emulsifier ("Emal 10", tradename, manufactured by Kao Corporation) and 80 g of dipropylene glycol monomethyl ether, were added and heated to 85° C. the mixture was stirred for 5 minutes at a rotational speed of 3,000 rpm by a homomixer, followed by emulsification by a high pressure homogenizer, manufactured by Golin Co., to obtain a preemulsion having an average particle size of 0.3 μm.

1,500 g of the obtained preemulsion was put into a 3l autoclave equipped with a stirrer and a deaerating valve, and MIBK and a part of deionized water were distilled under a reduced pressure (100 mmHg). 15 Hours later, 550 g of a distillate was observed, and in the autoclave, 949 g of an emulsion having a solid content concentration of 40 wt %, was obtained. The obtained emulsion was diluted with deionized water to a solid content concentration of 30%, to obtain an aqueous dispersion of the reaction product (A).

EXAMPLE 3

Preparation of an Aqueous Dispersion of Reaction Product (A)

The preparation was carried out in the same manner as in Example 2 except that instead of the anionic emulsifier, 12.7 g of a cationic emulsifier ("ARQUAD 18-63", tradename, manufactured by Lion Corporation) was used. The average particle size of a preemulsion obtained by high pressure emulsification was 0.25 μm. By a solvent-removal operation, 960 g of an emulsion having a solid content concentration of 39.5 wt %, was obtained. The obtained emulsion was diluted with deionized water to a solid content concentration of 30%, to obtain an aqueous dispersion of reaction product (A).

EXAMPLE 4

Preparation of an Aqueous Dispersion of Addition Polymer (B)

Into a 1l container, 29.5 g of FA, 265.2 g of methyl methacrylate (hereinafter referred to as MMA), 8.8 g of sodium n-dodecylbenzenesulfonate, 0.9 g of n-dodecylmercaptan and 445 g of deionized water were added and heated to 60° C. The mixture was stirred for 5 minutes at a rotational speed of 3,000 rpm by a homomixer and then emulsified by a high pressure homogenizer, manufactured by Golin Co., to obtain a preemulsion.

700 g of the obtained preemulsion was charged into a 1l autoclave equipped with a stirrer, and the autoclave was flushed with nitrogen. Then, 0.6 g of ammonium persulfate was added thereto, followed by polymerization at 60° C. for 8 hours. The obtained emulsion was such that the fluorine content in the polymer was 6.1 wt %, the average particle size was 0.28 μm, and the solid content concentration was 38 wt %. The obtained emulsion was diluted with deionized water to a solid content concentration of 30% to obtain a stable aqueous dispersion of the addition polymer (B).

EXAMPLES 5 to 13

Preparation of Aqueous Dispersions of Addition Polymer (B)

Stable aqueous dispersions of the addition polymer (B) having a solid content concentration of 30%, were obtained in the same manner as in Example 4 except that the monomer was changed to those identified in Table 3.

EXAMPLES 14 to 16

Stable aqueous dispersions of the addition polymer (B) having a solid content concentration of 30%, were obtained in the same manner as in Example 4 except that the monomer was changed to those identified in Table 3, 6.0 g of a cationic emulsifier ("ARQUAD 18–63", tradename, manufactured by Lion Corporation) and 24.0 g of a nonionic emulsifier ("Emulgen 930", tradename, manufactured by Kao Corporation), were used instead of 8.8 g of sodium n-dodecylbenzenesulfonate, and an azo type polymerization initiator ("V-50", tradename, manufactured by Wako Junyaku Kogyo K.K.) was used instead of ammonium persulfate.

TABLE 3

| Example No. | Composition of monomers (wt %) | Fluorine content in the polymer (wt %) | Average particle size (μm) | Solid content concentration (wt %) |
|---|---|---|---|---|
| 5 | FA/MMA (5/95) | 3.2 | 0.29 | 36.0 |
| 6 | FA/MMA (15/85) | 9.5 | 0.22 | 36.2 |
| 7 | FA/MMA (20/80) | 12.6 | 0.19 | 35.8 |
| 8 | FA/MMA (40/60) | 24.7 | 0.17 | 35.6 |
| 9 | FA/MMA/MAA (10/85/5) | 6.3 | 0.28 | 36.0 |
| 10 | FA/MMA/ST/MAA (10/60/25/5) | 6.3 | 0.31 | 36.0 |
| 11 | MMA/IBMA/MAA (50/45/5) | 0.0 | 0.28 | 36.2 |
| 12 | MMA/MAA (90/10) | 0.0 | 0.25 | 36.1 |
| 13 | FA/MMA (85/15) | 53.5 | 0.12 | 35.5 |
| 14 | FA/MMA (5/95) | 2.9 | 0.32 | 35.5 |
| 15 | FA/MMA (15/85) | 8.6 | 0.25 | 35.8 |
| 16 | FA/MMA (20/80) | 11.5 | 0.22 | 35.8 |

ST: Styrene, MAA: Methacrylic acid, IBMA: Isobutyl methacrylate

EXAMPLE 17

10 g of the aqueous dispersion of the reaction product (A) obtained in Example 2 and 10 g of the aqueous dispersion of the addition polymer (B) obtained in Example 4 were mixed to obtain a treating stock liquid. The treating stock liquid had a solid content concentration of 30 wt %, the weight ratio of the reaction product (A) to the addition polymer (B) in the solid content, was 50/50. Using this treating stock liquid, the following treating composition was prepared.

Treating composition: 5.0 g of the treating stock liquid, 0.75 g of DIMAFIX (polyhydric phenol sulfonic acid-containing treating agent), manufactured by Meisei Kagaku K.K., and 244.25 g of deionized water.

On a 6,6—nylon carpet, the above treating composition was spray-coated and then dried at 130° C. for 5 minutes, and thereafter, it was left to stand at 25° C. under relative humidity of 65% for 24 hours to obtain a test cloth, which was evaluated. The results are shown in Table 4. With the non-treated carpet, the dry soil resistance was 25.0, the water repellency was 0, and the oil repellency was 0.

EXAMPLES 18 and 32

The operation was carried out in the same manner as in Example 17 except that 10 g of the aqueous dispersion of the reaction product (A) obtained in Example 2 or 3 and the aqueous dispersion of the addition polymer (B) obtained in one of Examples 5 to 16 were used in the combination and the ratio as identified in Table 4. The results are shown in Table 4.

TABLE 4

| Example No. | Reaction product (A) | Addition polymer (B) | A/B (weight ratio) | Dry soil resistance (color difference) | Water repellency | Oil repellency |
|---|---|---|---|---|---|---|
| 17 | Ex. 2 | Ex. 4 | 50/50 | 11.0 | 2 | 5 |
| 18 | Ex. 2 | Ex. 5 | 50/50 | 11.2 | 4 | 3 |
| 19 | Ex. 2 | Ex. 5 | 20/80 | 12.2 | 5 | 4 |
| 20 | Ex. 2 | Ex. 5 | 70/30 | 11.0 | 4 | 3 |
| 21 | Ex. 2 | Ex. 6 | 50/50 | 11.6 | 4 | 4 |
| 22 | Ex. 2 | Ex. 7 | 50/50 | 11.8 | 5 | 5 |
| 23 | Ex. 2 | Ex. 8 | 50/50 | 12.2 | 5 | 5 |
| 24 | Ex. 2 | Ex. 9 | 50/50 | 11.4 | 4 | 4 |
| 25 | Ex. 2 | Ex. 10 | 50/50 | 11.8 | 5 | 4 |
| 26 | Ex. 3 | Ex. 14 | 50/50 | 11.3 | 4 | 4 |
| 27 | Ex. 3 | Ex. 15 | 50/50 | 12.1 | 4 | 4 |
| 28 | Ex. 3 | Ex. 16 | 50/50 | 11.1 | 4 | 3 |
| 29 | Ex. 2 | Ex. 5 | 0/100 | 19.0 | 6 | 6 |
| 30 | Ex. 2 | Ex. 11 | 50/50 | 17.0 | 1 | 1 |
| 31 | Ex. 2 | Ex. 12 | 50/50 | 17.2 | 1 | 1 |
| 32 | Ex. 2 | Ex. 13 | 50/50 | 19.2 | 7 | 6 |

EXAMPLE 33

100 g of the aqueous dispersion of the reaction product (A) obtained in Example 2, 2 g of FA and 18 g of MMA were added and reacted in the same manner as in Example 4 to obtain a stable emulsion. The conversion of FA and MMA to the addition polymer was at least 99%. The obtained emulsion was adjusted with deionized water to a solid content concentration of 30%, to obtain a treating stock liquid, and evaluation was carried out in the same manner as in Example 17. The results are shown in Table 5.

EXAMPLE 34

To 100 g of the reaction product (A) obtained in Example 1, 8 g of FA, 72 g of MMA and 50 g of MIBK were added, followed by dissolution at 70° C. to obtain a solution. Then, 8 g of a nonionic emulsifier ("Emulsion 920", tradename, manufactured by Kao Corporation) and 2.4 g of a cationic emulsifier (an acetate of "FARMEEN DMC, tradename, manufactured by Kao Corporation) were added thereto, followed by heating to 85° C. Then, the mixture was stirred by a homomixer at 3,000 rpm for 5 minutes and then emulsified by a high pressure homogenizer manufactured by Golin Co., to obtain an emulsion having an average particle size of 0.4 μm.

Then, 0.1 g of azobisisobutyronitrile was added as a polymerization initiator, and the mixture was reacted at 60° C. for 20 hours. The conversion of FA and MMA was at least 99%. MIBK and unreacted monomers were distilled off under reduced pressure, to obtain a stable emulsion containing no solvent. The obtained emulsion was adjusted to a solid content concentration of 30% by deionized water, to obtain a treating stock liquid, and evaluation was carried out in the same manner as in Example 17. The results are shown in Table 5.

EXAMPLE 35

100 g of an aqueous dispersion of the addition polymer (B) obtained in Example 4 and 100 g of an aqueous dispersion (solid content concentration: 20%) of a homopolymer of MMA, were mixed to obtain a treating stock liquid, and evaluation was carried out in the same manner as in Example 17. The results are shown in Table 5.

EXAMPLE 36

99 Parts by weight of FA, 1 part by weight of n-dodecylmercaptan, 4 parts by weight of polyoxyethylenenonylphenyl ether (20 mols of added ethylene oxide), 60 parts by weight of acetone, 140 parts by weight of deionized water and 2 parts by weight of azobisisobutyronitrile were mixed and heated to 35° C. with stirring. Then, this mixture was emulsified by a high pressure homogenizer manufactured by Golin Co. and then put into a 1l autoclave equipped with a stirrer, and the inner air was replaced by nitrogen gas. Stirring was carried out for 5 hours at 70° C. to obtain an emulsion having an average particle size of 0.1 μm.

This emulsion was adjusted to a solid content concentration of 20 wt % by deionized water, and to 100 g of the adjusted emulsion, 2 g of FA and 18 g of MMA were added, followed by polymerization in the same manner as in Example 4. The conversion of FA and MMA after expiration of 20 hours was at least 99%. The product was cooled to room temperature to obtain a stable treating stock liquid, and evaluation was carried out in the same manner as in example 17. The results are shown in Table 5.

EXAMPLE 37

Into a 2l glass reactor equipped with a thermometer, a dropping funnel, a stirrer and a Dimroth condenser, 320 g of MIBK and 174 g of tolylene diisocyanate were charged, and the inner air was replaced by nitrogen. Then, the temperature was raised to 50° C. with stirring, and 510 g of FE heated to 70° C., was dropwise added thereto from the dropping funnel over a period of 2 hours. Then, 130 g of 2-hydroxyethyl methacrylate was dropwise added thereto over a period of 1 hour, and stirring was continued for further 3 minutes. The reaction crude liquid was analyzed by an infrared spectrometry, whereby disappearance of absorbance attributable to an isocyanate group, was confirmed. The solid content concentration of the reaction crude liquid was 67 wt %.

To 100 g of the reaction crude liquid, 20 g of MMA and 111 g of MIBK were mixed and heated to 70° C. to obtain a solution. To this solution, 300 g of deionized water, 8 g of a nonionic emulsifier ("Emulgen 920", tradename, manufactured by Kao Corporation), and 2.4 g of a cationic emulsifier ("FARMEEN DMC", tradename, manufactured by Kao Corporation)" were added, and the mixture was heated to 70° C. The mixture was stirred for 5 minutes at 300 rpm by a homomixer and then emulsified by a high pressure homogenizer manufactured by Golin co.

600 g of the emulsified product was cooled to 30° C. and charged into a 1l autoclave equipped with a stirrer, and 2 g of azobisisobutyronitrile was mixed thereto as a polymerization initiator. The inner air was replaced by nitrogen gas, and stirring was carried out for 5 hours at 70° C. The conversion of MMA measured by gas chromatograph was at least 99%. MIBK was distilled off under reduced pressure to obtain a stable treating stock liquid having an average particle size of 0.1 μm and containing no solvent. Using the obtained treating stock liquid, evaluation was carried out in the same manner as in Example 17. The results are shown in Table 5.

TABLE 5

| Example No. | Dry soil resistance (color difference) | Water repellency | Oil repellency |
|---|---|---|---|
| 33 | 11.0 | 4 | 4 |
| 34 | 10.8 | 4 | 4 |
| 35 | 17.0 | 1 | 1 |
| 36 | 19.5 | 4 | 4 |
| 37 | 17.2 | 1 | 1 |

The aqueous dispersion type antisoiling composition of the present invention is an excellent aqueous dispersion type antisoiling composition having both high dry soil resistance and high water and oil repellency. Further, it is easy to handle and advantageous from the viewpoint of the environmental protection, as it is of an aqueous dispersion type.

Further, the aqueous dispersion type antisoiling composition of the present invention forms a coating having high hardness, whereby it is possible to minimize damages to the coating when stones, mud, etc. are brought in contact therewith. Accordingly, it provides an antisoiling property over a long period of time when it is applied as an antisoiling composition to e.g. carpet or a curtain which will be subjected to a physical force repeatedly.

What is claimed is:

1. An aqueous dispersion type antisoiling composition comprising an aqueous medium, and fine particles of the following reaction product (A) and fine particles of the following addition polymer (B), dispersed in the aqueous medium, or an aqueous medium, and fine particles comprising the reaction product (A) and the addition polymer (B), dispersed in the aqueous medium:

Reaction product (A): a reaction product of compounds (a1), (a2) and (a3);

Compound (a1): a compound having a polyfluoroalkyl group and a group having an active hydrogen atom reactive with an isocyanate group;

Compound (a2): a compound having no polyfluoroalkyl group and a group having an active hydrogen atom reactive with an isocyanate group;

Compound (a3): a polyisocyanate compound;

Addition polymer (B): a copolymer comprising polymer units of a polyfluoroalkyl group-containing (meth) acrylate and polymer units of methyl methacrylate, wherein said copolymer has a fluorine content of from 5 to 20 wt %.

2. The aqueous dispersion type antisoiling composition according to claim 1, wherein the compound (a3) is trisbiuret of an aliphatic diisocyanate.

3. The aqueous dispersion type antisoiling composition according to claim 1, wherein the compound (a1) is a (perfluoroalkyl)alkyl alcohol.

4. The aqueous dispersion type antisoiling composition according to claim 1, wherein the compound (a2) is an epoxy group-containing alcohol or a linear alkyl alcohol having at least 16 carbon atoms.

5. The aqueous dispersion type antisoiling composition according to claim 1, wherein the fluorine-content in the addition polymer (B) is from 3 to 30 wt %.

6. The aqueous dispersion type antisoiling composition according to claim 1, wherein the weight ratio of the reaction product (A)/the addition polymer (B) is from 20/80 to 80/20.

7. The aqueous dispersion type antisoiling composition according to claim 1, which further contains an emulsifier.

8. The aqueous dispersion type antisoiling composition according to claim 2, wherein the compound (a1) is a (perfluoroalkyl)alkyl alcohol.

9. The aqueous dispersion type antisoiling composition according to claim 2, wherein the compound (a2) is an epoxy group-containing alcohol or a linear alkyl alcohol having at least 16 carbon atoms.

10. The aqueous dispersion type antisoiling composition according to claim 2, wherein the fluorine-content in the addition polymer (B) is from 3 to 30 wt %.

11. The aqueous dispersion type antisoiling composition according to claim 2, wherein the weight ratio of the reaction product (A)/the addition polymer (B) is from 20/80 to 80/20.

12. The aqueous dispersion type antisoiling composition according to claim 2, which further contains an emulsifier.

13. The aqueous dispersion type antisoiling composition according to claim 8, wherein the compound (a2) is an epoxy group-containing alcohol or a linear alkyl alcohol having at least 16 carbon atoms.

14. A fiber product which is treated with the aqueous dispersion type antisoiling composition as defined in claim 1.

15. A fiber product which is treated with the aqueous dispersion type antisoiling composition as defined in claim 2.

16. The aqueous dispersion type antisoiling composition according to claim 1, wherein reaction product (A) has a molecular weight of about 500 to 5000.

* * * * *